United States Patent [19]

Hodson

[11] 4,138,952

[45] Feb. 13, 1979

[54] COLLAPSIBLE TEA TABLE SYSTEM

[76] Inventor: Hollis C. Hodson, P. O. Box 114, Amo, Ind. 46103

[21] Appl. No.: 805,403

[22] Filed: Jun. 10, 1977

[51] Int. Cl.[2] ..... A47B 3/02

[52] U.S. Cl. ..... 108/116; 108/159

[58] Field of Search ..... 108/13, 116–118, 108/144, 146, 156, 157, 159, 11, 62; 24/73 AP; 273/287

[56] References Cited

U.S. PATENT DOCUMENTS

| | | | |
|---|---|---|---|
| 352,555 | 11/1886 | Merkel | 108/62 |
| 2,624,469 | 1/1953 | Cadwell et al. | 108/116 X |
| 2,903,312 | 9/1959 | Lawless | 108/13 UX |
| 3,001,843 | 9/1961 | Davis | 108/62 |
| 3,157,136 | 11/1964 | Moody | 108/157 X |
| 3,365,072 | 1/1968 | Hill | 108/116 X |

FOREIGN PATENT DOCUMENTS

| | | | |
|---|---|---|---|
| 215984 | 5/1924 | United Kingdom | 108/111 |
| 707880 | 4/1954 | United Kingdom | 108/116 |

*Primary Examiner*—James C. Mitchell

[57] ABSTRACT

In a collapsible tea table combination wherein a foldable X-legged stand provides level and lengthwise parallel crossbars, and supports the improved tray system, maximum usable planar spread of crossbars can be selectively spanned and detained by rails rigidly attached along two parallel sides of the tray-bed to provide a minimum usable tray elevation. Minimum usable planar spread of crossbars can be selectively spanned and detained by means of deformable hangbuttons inserted into apertures formed in the tray-bed near the rails to provide a maximum usable tray elevation. The tray can be rendered invertible by using reversible tray-bed material, by using rails which juts both above and below the tray-bed, and by using hangbuttons which are symmetrically contoured for vertical displacement and rotation. Inasmuch as hangbuttons rotate within their apertures, they serve as rotary locks for stabilizing a table erected from any one of the choice of practical tray settings.

4 Claims, 12 Drawing Figures

COLLAPSIBLE TEA TABLE SYSTEM

BACKGROUND OF THE INVENTION

This invention relates to the collapsible tea table which combines a foldable stand and a portable tray by means of connecting devices which are co-existent with the tray and adaptable to horizontal supporting elements of the stand.

There are numerous collapsible table combinations wherein a foldable, X-legged stand having horizontal and parallel crossbars supports a portable tray which is either flat or formed with flared rims, and wherein the connecting devices are flexible horseshoe grippers or other means rigidly attached to the under side of the exposed tray surface.

Tables of this type must be assembled and locked to be unitarily stable or portable, whereupon they serve their purposes well. They are, however, usually limited to one elevation and require forceable connection to the stand to yield a single upright surface. To effect combination or separation of stand and tray, most such tables require the simultaneous use of both hands and, in the process, require substantial respective push or pull. Thus, the process of assembly or disassembly interferes with the table composure.

SUMMARY OF THE INVENTION

In a collapsible tea table combination wherein a foldable X-legged stand provides level and lengthwise parallel crossbars, and supports a portable tray, an improved tray system:

1. rails jut above and below a reversible tray-bed for rendering the tray invertible, rails are rigidly attached along two parallel edges of the tray-bed for use in spanning and detaining maximum usable planar spread of crossbars beneath tray-bed at minimum usable tray elevation; and 2. unitary symmetrical hangbuttons are invertibly displaceable, rotable, of deformable matter, and have terminal tabs, which hangbuttons are manually inserted in tray-bed apertures near rails and used both for spanning and detaining minimum usable planar spread of crossbars beneath tray-bed at maximum usable tray elevation, and for locking a tray in various ways.

The object of the invention is to provide a smoother operation and to increase versatility of a collapsible tea table using the described tray system. Improvements to be shown provide for certain advantages, indicating:

control of crossbars by means of detainers, with or without hangbuttons, with or without locking;
minimal interface friction between crossbar and lock;
invertible crossbar detainers and tray-bed; and
a wide choice of tray settings.

DESCRIPTION OF THE PREFERRED EMBODIMENT

Figure 1:
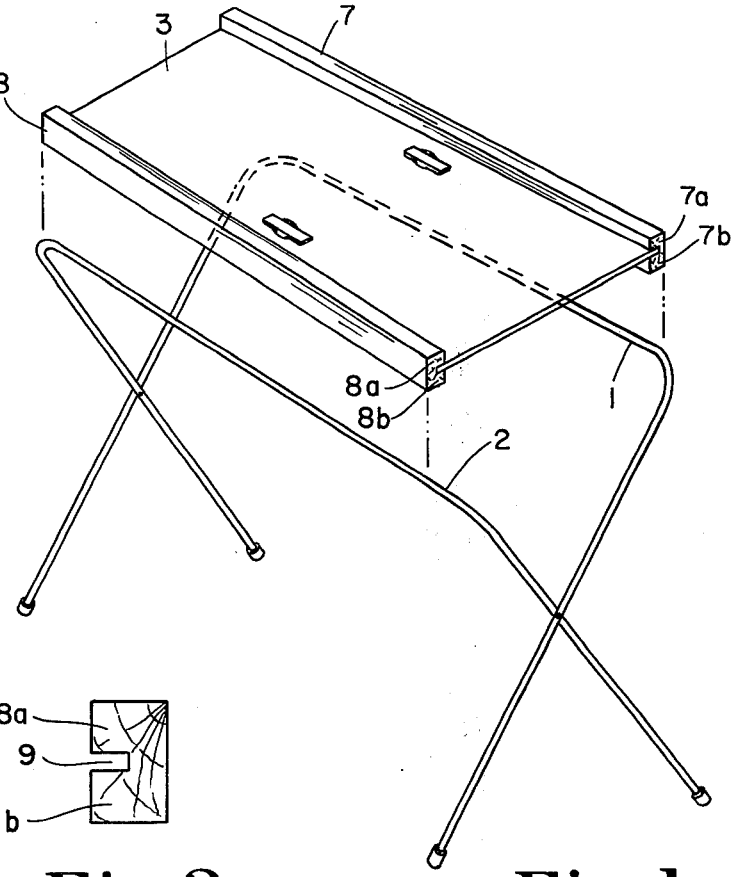
FIG. 1 is a perspective showing a foldable, X-legged stand having crossbars which are detainable by the jutting rails of the improved tray.

GLOSSARY—herinafter, as used in this description:

"crossbars" refer to top, parallel support elements in a foldable cross-legged stand such as the interconnecting bight portions of two inverted U-shaped tubular frames pivotally joined, and as illustrated at 1,2, FIG. 1;

"support position of crossbars" refers to a planar spread of stand crossbars detainable under a tray by some means;

"tray-bed" means a surface of thin reversible material used in a tray;

"edge" refers to either of two parallel longer bounds of a tray-bed;

"rail" means a detainer attachable along an edge of a tray-bed and juttable cross sectionally above and below;

"hangbutton" means an invertibly displaceable and rotatable detainer and lock with suspensory shaft terminals and terminal tabs;

"aperture" refers to a circular tray-bed opening to for retaining a hangbutton;

"upper tabs" refer to the pair of tabs of unequal mass protruding oppositely from the top of a hangbutton;

"lower tabs" refer to the pair of tabs of unequal mass protruding oppositely from the bottom of a hangbutton;

"finger tab" refers to the larger tab of a pair of upper or lower tabs designed; for chucking a crossbar;

"toe tab" refers to the smaller tab of a pair of upper or lower tabs; designed to lap the rim of an apperture;

"waist" means a contoured suspensory shaft and terminals;

"front-waist" means the face of a waist between finger tabs;

"back-waist" means the face of a waist between toe tabs;

"side-waist" means either smooth vertical face of a waist;

"cave" refers to a central void in a front-waist; and

"belly" refers to a bulge on a back-waist.

Measurement data applicable to the preferred embodiment;

| Item shown | FIG No. | Ref. No. | Left to right width | Fore to aft depth | Top to bottom height |
|---|---|---|---|---|---|
| Rail | | 7,8 | | | |
| cross section | 2 | | 1/2" min. | — | 3/4" min. |
| channel | 2 | 9 | 1/4" | — | 1/8" |
| spread | | | | 12-1/2" | |
| Hangbutton | 6 | | | | |
| overall | | | 1-1/2" ± | 3/8" | 3/4" |
| finger tab | | 12,22 | 7/16" ± | " | 3/32" ± |
| toe tab lab | | 14,24 | 1/4" ± | " | 1/16" ± |
| fit of waist | | 18 | 13/16" ± | " | 5/8" max. |
| mid-waist | | 16c–20b | 5/8" max. | 10-1/2" | 5/8" max. |

-continued

| Item shown | FIG No. | Ref. No. | Left to right width | Fore to aft depth | Top to bottom height |
|---|---|---|---|---|---|
| spread | | | | | |
| Other | | | | | |
| aperture center | 4 | | midway tray-bed, 1" from rail | | |
| aperture diameter | 3 | 10,11 | 7/8" | | |
| tray-bed | 3 | 3b | 1/8" thick × 13" × 17-1/8" | | |

The above dimensions contemplate round crossbars having a cross sectional diameter of ½ inch.

Figure 6:
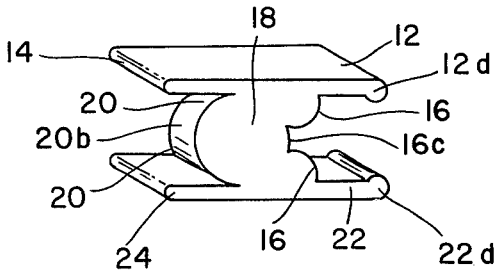
FIG. 6 is a side view of a molded hangbutton.

Mold diameters to conform the unit of FIG. 6 are ⅛", 5/16", ⅝", and 1/16", right to left.

Figure 7:
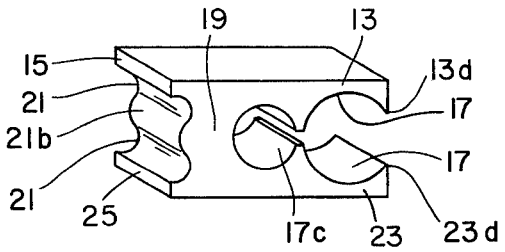
FIG. 7 is a side view of a machined hangbutton.

Drill diameters to conform the unit of FIG. 7 are ⅝", 7/64", 7/16", and 7/32", right to left, with drillings from smallest diameter to largest diameter, made left to right, and with drills set as close as presses permit.

Figure 3:
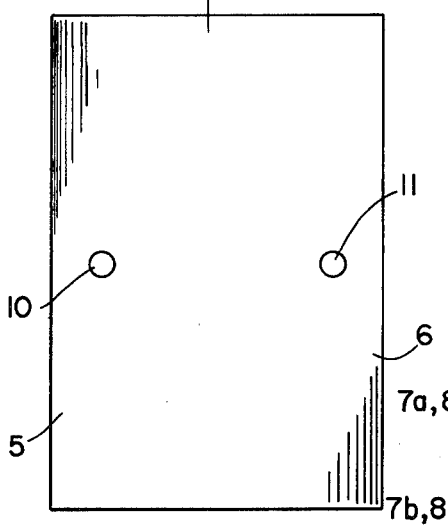
FIG. 3 is a top view of a flat smooth tray-bed.
Figure 2:
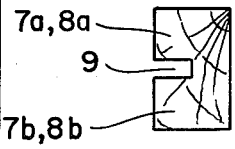
FIG. 2 is a cross sectional view of a bilevel rail.
Figure 4:
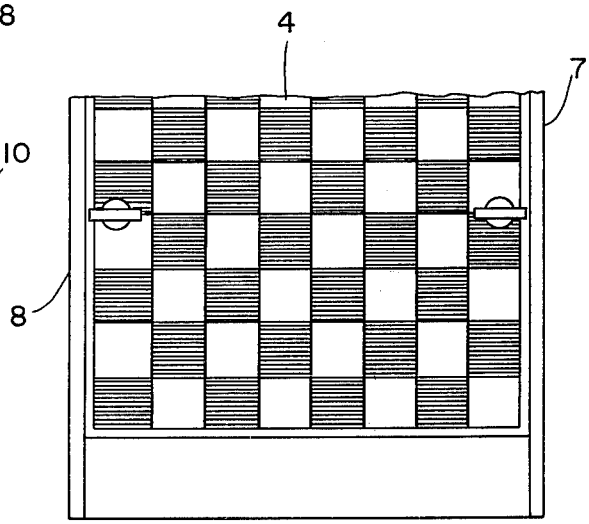
FIG. 4 is a cutaway illustrating one use of the inverted tray.

In the drawings, FIG. 1, a conventional foldable, X-legged stand supports an improved tray 3 upon crossbars 1 and 2 of the stand, which crossbars can be spanned and detained without locking, by rails 7 and 8 attached to and jutting both a, above, and b, below, the tray-bed. Any detainer must exceed the radius of a crossbar. In the preferred embodiment, the cross section of a rail, FIG. 2, is ½" × ¾" and shows a rabbeted center channel 9 of ¼" × ⅛". Rails 7 and 8 attach to the tray-bed 3*b* by gluing the edges 5 and 6 of FIG. 3 into rail channel 9 of FIG. 2, leaving at least 5/16" to jut above and below the tray-bed for detaining crossbars having ½" diameter. The up-and-down rail permits using the rails as well with a reverse side 4 of a tray-bed as shown in FIG. 4, e.g., for printing a design on the inverted tray.

Figure 5:
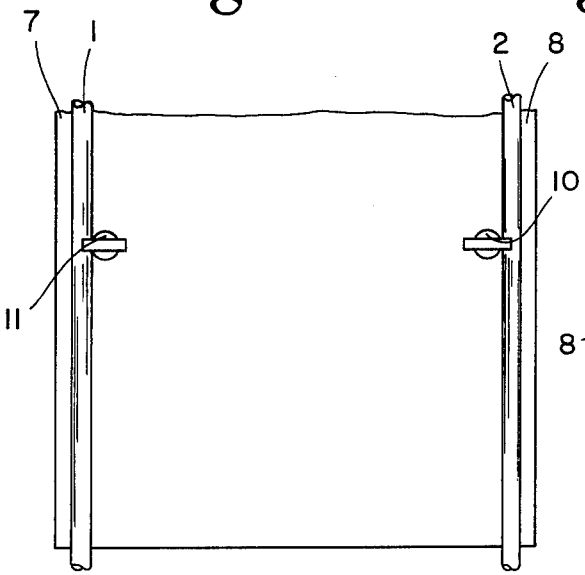
FIG. 5 is a cutaway view of the table inverted showing two apertures positioned with respect to rails and crossbars.

To lock a tray upon crossbars, the hangbutton to be disclosed below will require a favorably located aperture where the unit can be retained, yet, the unit must be free to be rotated as well as be free to move up and down. Two hangbuttons per tray are sufficient. Apertures 10 and 11 as shown in FIGS. 3 and 5 are ⅞" circular openings in the tray-bed and are centered 1" inward and midway of the rails.

While tray-bed, rails, and aperture combination may be fabricated as a unit, the example used wooden rails, double surfaced ⅛" hardboard and the apertures were drilled. Other methods of fabrication are competitive in cost.

Two satisfactory locks are shown, a molded hangbutton, FIG. 6, even numbered parts 12 through 24, and an optional machined hangbutton, FIG. 7, odd numbered parts 13 through 25. FIG. 6 design is extruded and cut to ⅜" widths, or it can be injection molded. FIG. 7 design is made by successive drillings on ¾" × ⅜" rod. Each lock features distended tips on finger tabs, 12*d*, 13*d*, 22*d*, 23*d*, which tips will be discussed below. High density polyethylene resin gives the ideal slippage, toughness, deformation, flexibility, elasticity, and cost, although polypropylene is optional.

In the ensuing description, explanations as to the preferred FIG. 6 design may be read respectively upon FIG. 7 by substituting the odd number consecutively next following the even part number used with respect to FIG. 6.

Figure 9:
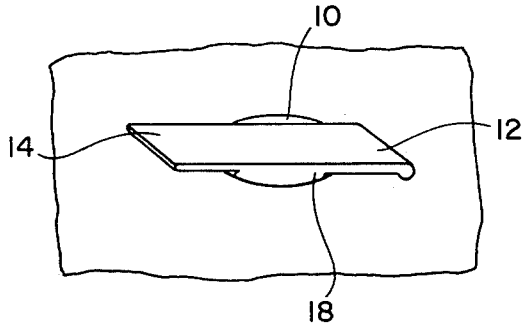
FIG. 9 is a sectional cutout showing the top of a hangbutton after insertion and at rest.
Figure 11:
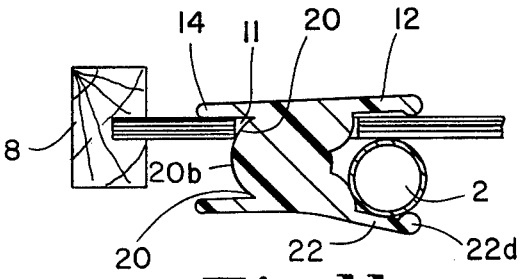
FIG. 11 is a fragmentary cross sectional side view illustrating position of crossbar detained between hangbuttons and locked.
Figure 12:
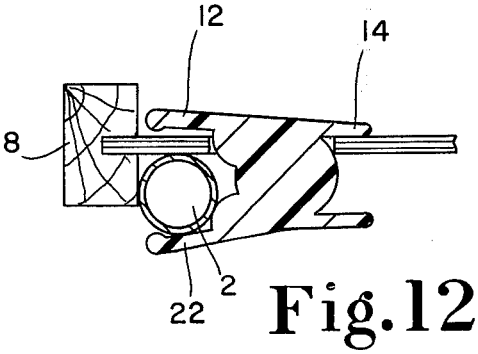
FIG. 12 is a fragmentary cross sectional side view illustrating position of crossbar detained and locked at the rail.

In FIG. 6, 12 and 14 are upper tabs; 22 and 24 are lower tabs; 12 and 22 are finger tabs of which 12*d* and 22*d* are tips; 14 and 24 are toe tabs; 16 is a front-waist of which 16*c* is a cave; 20 is a back-waist of which 20*b* is a belly; and 18 is a smooth side-waist. The hangbutton profile is symmetrical with respect to a horizontal plane passing through the middles of cave and belly, thus the unit is invertible for use vice versa. The upper tabs 12 and 14 suspend the unit from aperture 10, FIG. 9, and provide manual torsional levers for rotating the unit. At ⅛" above and below the tabs, the planar waist expanse from the front-waist 16 to back-waist 20 is 13/16" × ⅜" wide, and snugs into the rectangular area available in the central ⅜" of a ⅞" aperture 10, FIG. 9, for smooth and even rotation. As the lower finger tab 22, FIG. 11, is rotated against and is forced down to engage crossbar 2, pressure tends to transfer diagonally to toe tab 14. However, the back-waist belly 20*b* prevents escape and reacts to wedge the toed rim of aperture 11 into the upper trough at the juncture of toe tab 14 and back-waist 20; thus, lower finger tab 22 becomes a catch for locking the tray onto a crossbar.

Because distended finger tip 22*d* chocks a crossbar 2 when tab 22 intersects crossbar 2 at right angles as in FIG. 11, the configuration keeps tab 22 reposed in a locking position until forced to move. During a rotational locking or unlocking, the distended tip slightly increases flexing stress upon the tab but reduces interim interface between tab and crossbar. Hence, reduced frictional drag is effectively dissipated against the greater inertia of the tray weight, thus eliminating assembly disturbances.

Figure 8:
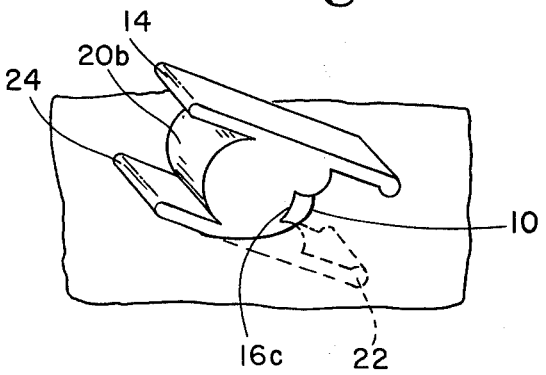
FIG. 8 is a sectional cutout showing a hangbutton threaded into an aperture.

The cave 16*c* comes into play when a hangbutton is inserted or removed. To insert the unit, lower finger tab 22 threads into aperture 10, FIG. 8. Pressure upon the top of the unit urges the cave 16*c* around the rim of the aperture to the point where the toe tab 24 deforms upward and slides through the aperture. Once a toe tab is inside, the rest of the hangbutton unit gravitates along the contoured faces of the waist to upper tabs where the unit reposes, FIG. 9. When the tray is inverted, skidding gravitation occurs upon the inverted hangbutton as the aperture rim guides the belly 20*b* and by-passes cave 16*c*. Thus, an inverted hangbutton maintains its profile vice versa.

To remove a hangbutton, it is raised halfway and pushed into the cave 16*c* whereupon upper toe tab 14 is forceably tucked through the aperture and the rest of the unit follows. It is easier to insert a hangbutton than to remove it and this is as it should be, e.g., as a tampering safeguard.

FIG. 6 side view portrays a hangbutton side-waist 18, one of two such smooth vertical surfaces per each hangbutton. This side-waist can function as a selective crossbar spanner and detainer. For example, using two tray-bed apertures, one per each rail as shown in FIGS. 4 and 5, and centered an inch inward and midway of the rail, and with a hangbutton inserted into each aperture as in FIG. 9, each hangbutton is then rotated to the posture shown in FIG. 10, thus aligning side-waist 18 parallel with rail 8 ready for setting tray over crossbars. A tray with rails and hangbuttons may selectively span over any one of three usable planar spreads, viz., as where, (A) each of both crossbars is detained by a rail as in FIG. 5 and in the attitude shown by 2 and 8 in FIG. 12, or (B) each of both crossbars is detained by a hangbutton side-waist in the attitude shown by 2 and 18 in FIG. 10, or (C) one crossbar is detained at the rail as in FIG. 12 while the other crossbar is detained by a hangbutton side-waist as in FIG. 10. Any planar spread is usable when detained. Inasmuch as the tray elevation varies inversely with the crossbar planar spread, spread (A), above, represents maximum spread of crossbars detainable by the improved tray for a minimum usable tray elevation, (B) yields a minimum spread and a maximum tray elevation whereas (C) yields a median spread and elevation.

Correlative situations (A'), (B'), and (C') spreads are selectively available by tray inversion inasmuch as an inverted hangbutton gravitates through its aperture where it cooperates vice versa with the two-way rail.

Figure 10:
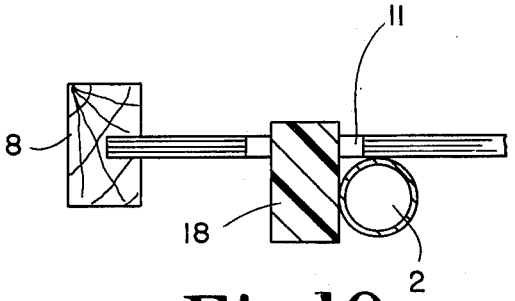
FIG. 10 is a fragmentary cross sectional side view illustrating relative positions of a hangbutton parallel to a rail as when crossbars are detained inwardly between hangbuttons.

Irrespective of spread (A), (B), or (C) or the like, once a tray is set over crossbars, stabilization may then be entirely effected by employing hangbuttons as locks, e.g., by manually rotating each hangbutton from its FIG. 10 pose until lower finger tip 22*d* skids beneath and chocks adjacent crossbar 2 as in FIG. 11. However, a crossbar may be locked wherever detained beneath the tray-bed. To illustrate, FIG. 11 shows the resultant lock posture of a hangbutton having been rotated 90 degrees after crossbar 2 was detained by a hangbutton side-waist 18 as in FIG. 10; FIG. 12 shows the lock posture of a hangbutton after a crossbar 2 was detained at rail 8. See also FIG. 5.

Thus, it is possible, considering three usable crossbar spreads per each of two usable tray sides, to have six tray settings per tray plus choice as to locking the tray or not.

The described tray is purposely plain but is alterable, within the concept of the invention, to combine adornment with utility and low cost. Tastefully contoured rails can be milled in continuous strips on a picture-frame molding shaper; tray-beds will cut from standard 4' × 8' hardboard without waste, can be ornamented by ordinary woodworking tools; or a unitary tray can be molded to a given design.

What is claimed is:

1. An improved tea table tray system, for use on foldable cross-legged stands having complementary legs interconnected by upper crossbars which are moved apart whenever supporting a top, and wherein said tray system improvement comprises:

a. a flat tray-bed having a rail rigidly attached along each of two parallel edges of said tray-bed, which said rails jut below said tray-bed for detaining said stand crossbars whenever said crossbars are moved to a first support position beneath said tray-bed whereat said crossbars are arrested by abutting said rails;

b. at least one aperture provided through said tray-bed inward of each said rail; and c. a deformable hangbutton inserted into each said aperture, which said hangbuttons depend from said tray-bed for detaining said stand crossbars whenever said crossbars are moved to a second support position beneath said tray-bed whereat said crossbars are arrested by abutting said hangbuttons, and furthermore, which said hangbuttons may be rotated within their respective said apertures for locking said crossbars beneath said tray-bed and abutting said rails in said first support position, and for locking said crossbars beneath said tray-bed and abutting said hangbuttons in said second support position.

2. The tray system of claim 1, wherein said tray-bed is made of reversible material, said rails jut above and below said tray-bed, and said hangbuttons are vertically symmetrical and invertibly displaceable and gravitation within their respective said apertures, whereby said tray system is equally cooperative whenever either side of said tray-bed is surfaced.

3. An improved tea table tray system, for use on foldable cross-legged stands having complementary legs interconnected by upper crossbars which are moved apart whenever supporting a top, and wherein said tray system improvement comprises:

a. a tray having at least one aperture provided through the tray-bed inward of each of two parallel edges of said tray-bed as means for disposing deformable crossbar detainers through said tray; and b. means disposed within said apertures for detaining said stand crossbars whenever said crossbars are moved to a support position beneath said tray-bed whereat said crossbars are arrested by abutting said detainers, said means comprising manually rotatable, vertically symmetrical and invertibly displaceable hangbuttons.

4. A portable tray system for collapsible tea tables, said tray system comprising:

a. a tray having rails attached along two parallel edges of said tray means for positioning said tray upon a foldable cross-legged stand;

b. circular apertures formed through said tray as means for disposing locks through said tray; and c. means disposed within said apertures for locking said tray to said stand, said means comprising manually rotatable hangbuttons.

* * * * *